US005498188A

United States Patent [19]

Deahr

[11] Patent Number: 5,498,188

[45] Date of Patent: Mar. 12, 1996

[54] CHILD-CONSTRUCTABLE TOYS THAT ARE ASSEMBLED USING A SYSTEM OF COLOR-COORDINATED COMPONENTS AND TOOLS

[76] Inventor: Christine M. Deahr, W6415 Kroghville Rd., Waterloo, Wis. 53594

[21] Appl. No.: 369,103

[22] Filed: Jan. 5, 1995

[51] Int. Cl.[6] ..... A63H 33/04; A63H 33/12; A63H 3/52

[52] U.S. Cl. ..... 446/75; 446/123; 446/478; 446/901

[58] Field of Search ..... 446/75, 76, 71, 446/85, 86, 108, 111, 112, 113, 115, 116, 121, 122, 123, 478, 901; 434/219, 259, 260

[56] References Cited

U.S. PATENT DOCUMENTS

| | | | |
|---|---|---|---|
| 2,479,203 | 8/1949 | Brown | 446/71 X |
| 3,002,318 | 10/1961 | Carver | 446/144 |
| 4,183,154 | 1/1980 | Dykes | 446/123 X |
| 4,946,414 | 8/1990 | Zimmer | 446/71 |
| 4,978,301 | 12/1990 | Dodge | 446/108 X |
| 5,121,710 | 6/1992 | Gonzalez | 446/476 X |
| 5,217,402 | 6/1993 | Gross et al. | 434/260 X |
| 5,313,747 | 5/1994 | Sakihara | 446/112 X |
| 5,330,379 | 7/1994 | Roh et al. | 446/901 X |

FOREIGN PATENT DOCUMENTS

| | | | |
|---|---|---|---|
| 538826 | 3/1957 | Canada | 434/260 |
| 1300206 | 6/1962 | France | 446/85 |

*Primary Examiner*—Robert A. Hafer
*Assistant Examiner*—D. Neal Muir

[57] ABSTRACT

A child-constructable toy including a set of components, each component having a characteristic color, each component further having a plurality of edges bearing other characteristic colors; a tool-actuateable coupling mechanism having a same characteristic color as that on an edge of one component and that on an edge of another component for coupling the same colored edges of the components together and with such repeated coupling allowing a toy to be created; and a tool operatively associated with the coupling mechanism for facilitating coupling of components.

6 Claims, 5 Drawing Sheets

CHILD-CONSTRUCTABLE TOYS THAT ARE ASSEMBLED USING A SYSTEM OF COLOR-COORDINATED COMPONENTS AND TOOLS

BACKGROUND OF THE INVENTION

1. Field of the Invention

The present invention relates to a child-constructable toys that are assembled using a system of color-coordinated components and tools and more particularly pertains to allowing a child to learn to recognize and match colors, to learn how to manipulate tools, and to learn basic construction principles with child-constructable toys that are assembled using a system of color-coordinated components and tools.

2. Description of the Prior Art

The use of constructable toys is known in the prior art. More specifically, constructable toys heretofore devised and utilized for the purpose of use by a child are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,968,615 to Ivany discloses a method, building structure and block therefore. U.S. Pat. No. 4,237,670 to De Waele discloses a building block set and method for building with such a block set. U.S. Pat. No. 4,602,908 to Kroeber discloses a toy building block set. U.S. Pat. No. 4,708,684 to Chen discloses a toy building block set. U.S. Pat. No. 4,887,403 to Bonner discloses an internally indexed building block and method of construction. U.S. Pat. No. 5,061,218 to Garage et al. discloses toy building blocks.

While these devices fulfill their respective, particular objective and requirements, the aforementioned patents do not describe child-constructable toys that are assembled using a system of color-coordinated components and tools. In this respect, the present invention substantially departs from the conventional concepts and designs of the prior art. In doing so, the present invention provides an apparatus primarily developed for the purpose of allowing a child to learn to recognize and match colors, to learn how to manipulate tools, and to learn basic construction principles.

Therefore, it can be appreciated that there exists a continuing need for new and improved child-constructable toys that are assembled using a system of color-coordinated components and tools which can be used for allowing a child to learn to recognize and match colors, to learn how to manipulate tools, and to learn basic construction principles. In this regard, the present invention substantially fulfills this need.

SUMMARY OF THE INVENTION

In the view of the foregoing disadvantages inherent in the known types of constructable toys now present in the prior art, the present invention provides improved child-constructable toys that are assembled using a system of color-coordinated components and tools. As such, the general purpose of the present invention, which will be described subsequently in greater detail, is to provide new and improved child-constructable toys that are assembled using a system of color-coordinated components and tools which have all the advantages of the prior art and none of the disadvantages.

To attain this, the present invention essentially comprises, in combination, a rectangular rigid planar plastic floor component of a red characteristic color. The floor component has an upper surface, a lower surface, and a periphery interconnecting the surfaces formed of a pair of long edges with a pair of short edges extended therebetween. Each long edge of the floor component has a plurality of circular and spaced nail seating holes formed therealong with each nail seating hole bearing a marking circle of an orange characteristic color therearound. Each short edge of the floor component has a plurality of circular and spaced screw seating holes formed therealong with each screw seating hole bearing a marking circle of a green characteristic color therearound. Each edge of the floor component further has a strip of pile-type fastener of a yellow characteristic color removably coupled thereto. Each strip of the floor component has a plurality of spaced through holes formed thereon. Each through hole on the strip is axially and separately aligned with one of the nail seating holes. Each through hole on the strip has a diameter greater than that of the associated nail seating hole to allow the corresponding marking circle to remain visible.

A pair of rectangular rigid planar plastic upstanding side wall components of an orange characteristic color are included. Each side wall component has an interior surface, an exterior surface, and a periphery interconnecting the surfaces formed of a top edge, a bottom edge, and opposed side edges extended therebetween. Each top edge of a side wall component has a plurality of spaced circular nail seating holes disposed therealong. Each side edge of a side wall component has a plurality of threaded screw seating holes disposed therealong. Each side wall component further has a plurality of nail through holes disposed thereon at a location aligned with and adjacent to the bottom edge thereof. Each nail through hole of a side wall component bears a marking circle of an orange characteristic color therearound on both the interior and exterior surfaces. Each top edge of a side wall component has a strip of pile-type fastener of a blue characteristic color removably coupled thereto. Each screw seating hole on each side edge of a side wall component bears a marking circle of a green characteristic color therearound. Each strip on the top edge of a side wall component has a plurality of circular spaced through holes formed therealong with each through hole separately and axially aligned with one of the nail seating holes. Each through hole of the strip has a diameter greater than the associated nail seating hole to allow the corresponding marking circle to remain visible. Each side edge of a side wall component has a strip of pile-type fastener of a yellow characteristic color removably coupled thereto. Each strip on a side edge of a side wall component has a plurality of circular spaced through holes formed therealong. Each through hole is separately and axially aligned with one of the screw seating holes. Each through hole of a side wall component has a diameter greater than the associated screw seating hole to allow the corresponding marking circle to remain visible. Each interior surface of a side wall component has a strip of complementary pile-type fastener of a yellow characteristic color removably coupled thereto at a location aligned with the nail through holes. Each strip has a plurality of spaced circular through holes formed therealong. Each through hole on a strip is separately and axially aligned with one of the nail through holes. Each through hole has a diameter greater than the associated nail through hole to allow the corresponding marking circle to remain visible.

A pair of rigid planar plastic end wall components of an orange characteristic color are included. Each end wall component has a triangular-shaped upper portion integral with a rectangular-shaped lower portion. Each end wall component has an interior surface, an exterior surface, and a periphery interconnecting the surfaces formed of a pair of angled upper side edges meeting at an apex, a pair of lower side edges extended downward from the upper side edges, and a bottom edge perpendicularly extended between the lower side edges. Each end wall component further includes a plurality of spaced and threaded screw through holes disposed therearound near the periphery thereof. Each screw through hole bears a marking circle of a green characteristic color therearound on both the interior and exterior surfaces. Each end wall component additionally has strips of complimentary pile-type fastener of a yellow characteristic color removably coupled therearound on the interior surface near the periphery thereof. Each strip has a plurality of spaced circular through holes formed therealong. Each through hole of a strip is separately and axially aligned with one of the screw through holes. Each through hole of a strip having a diameter greater than the associated screw through hole to allow the corresponding marking circle to remain visible. One of the end wall components has a circular aperture disposed centrally therethrough to define an open door.

A roof component formed of a pair of interconnected plates defining a V-shaped configuration is provided. The roof component is formed of plastic with a red characteristic color. The roof has an upper surface, a lower surface, and a periphery interconnecting the upper surface with the lower surface formed of a pair of bottom edges and pair of opposed V-shaped side edges extended therebetween. Each bottom edge of the roof component has a plurality of spaced nail through holes disposed therealong. The nail through holes are extended upwards through the upper surface of the roof component. Each nail through hole has a marking circle of an orange characteristic color therearound on both the upper surface and bottom surfaces. Each bottom edge of the roof component has a strip of complimentary pile-type fastener of a blue characteristic color removably coupled thereto. Each strip has a plurality of spaced circular through holes formed therealong. Each through hole is separately and axially aligned with one of the nail through holes. Each through hole has a diameter greater than the associated nail through hole to allow the corresponding marking circle to remain visible.

A rigid plastic hammer of an orange characteristic color is included. The hammer has an elongated hammering portion with a head at one end, a ball at the other end, and a shaft therebetween and an elongated tubular hollow handle extended outwards from the shaft and terminated at a sealed rounded tip end. A rigid plastic screwdriver of a green characteristic color is included. The screwdriver has a handle with a tubular shaft extended therefrom and terminated at a flat tip.

A set of rigid plastic nails of an orange characteristic color are included. Each nail has a head at one end, a pointed tip at the other end, and a conical intermediate portion therebetween. Each nail is separately disposed within a nail through hole and seated within a corresponding nail seating hole and with the nails in combination with associated pile type fasteners and complementary pile type fasteners securing the floor and roof to the side wall components.

A set of rigid plastic screws of a green characteristic color are included. Each screw has a slotted head at one end, a pointed tip end, and a conical intermediate portion with a helical thread extended between the ends. Each screw is threadedly disposed within a screw through hole and seated within a corresponding screw seating hole and with the screws in combination with the associated pile type fasteners and complimentary pile type fasteners securing the end wall components to the roof, floor, and side wall components.

Lastly, a carrying bag is provided. The carrying bag is formed of a net material with a central opening. The carrying bag also has a drawstring secured around the central opening. The carrying bag has a size for holding the components and tools therein for storage and transport.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved child-constructable toys that are assembled using a system of color-coordinated components and tools which has all the advantages of the prior art constructable toys and none of the disadvantages.

It is another object of the present invention to provide a new and improved child-constructable toys that are assembled using a system of color-coordinated components and tools which may be easily and efficiently manufactured and marketed.

It is a further object of the present invention to provide a new and improved child-constructable toys that are assembled using a system of color-coordinated components and tools which is of durable and reliable construction.

An even further object of the present invention is to provide a new and improved child-constructable toys that are assembled using a system of color-coordinated components and tools which is susceptible of a low cost of manufacture with regard to both materials and labor, and which accordingly is then susceptible of low prices of sale to the consuming public, thereby making such a child-constructable toys that are assembled using a system of color-coordinated components and tools economically available to the buying public.

Still yet another object of the present invention is to provide a new and improved child-constructable toys that are assembled using a system of color-coordinated components and tools which provides in the apparatuses and methods of the prior art some of the advantages thereof, while simultaneously overcoming some of the disadvantages normally associated therewith.

Even still another object of the present invention is to provide a new and improved child-constructable toys comprising a set of components, each component having a characteristic color, each component further having a plurality of edges bearing other characteristic colors; and coupling means having a same characteristic color as that of a color on an edge of one component and a color on an edge of another component for coupling the same colored edges of the components together and with such repeated coupling allowing a toy to be created.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
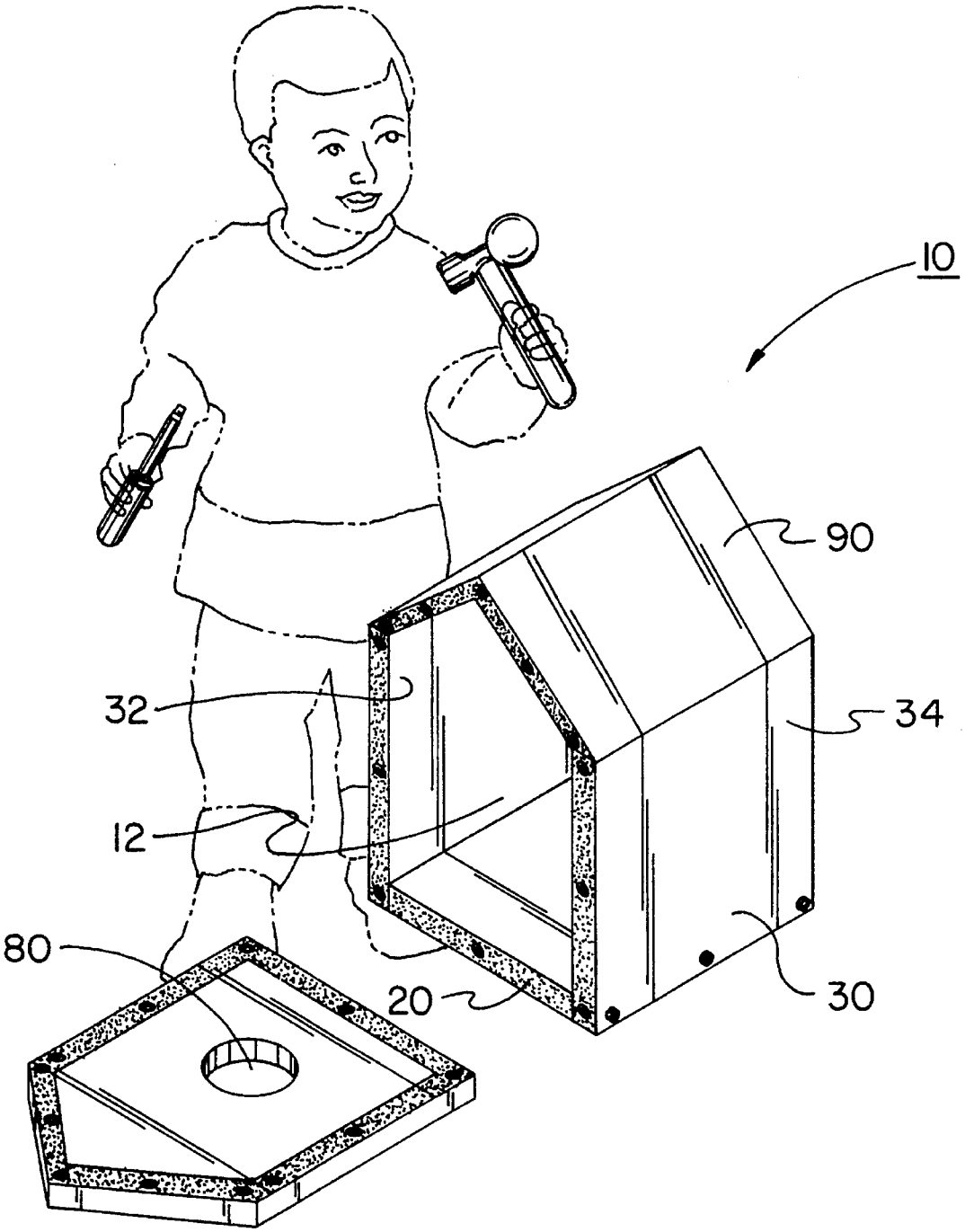
FIG. 1 is a perspective view of the preferred embodiment constructed in accordance with the principles of the present invention being constructed by a child.
Figure 2:
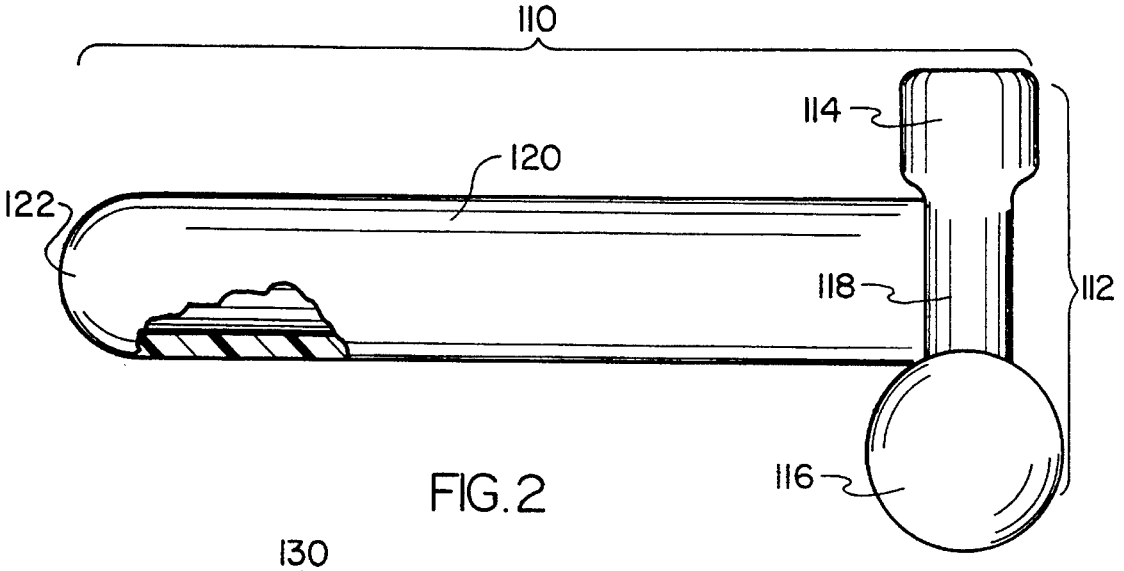
FIG. 2 is a side-elevational view of the hammer of the present invention.
Figure 3:
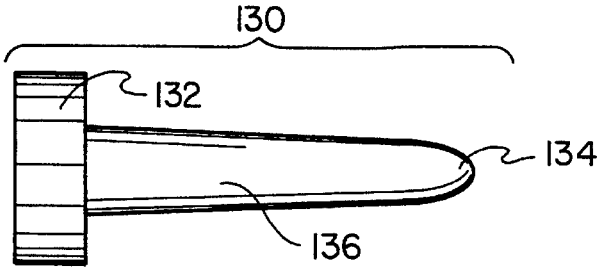
FIG. 3 is a side-elevational view of a nail of the present invention.
Figure 4:
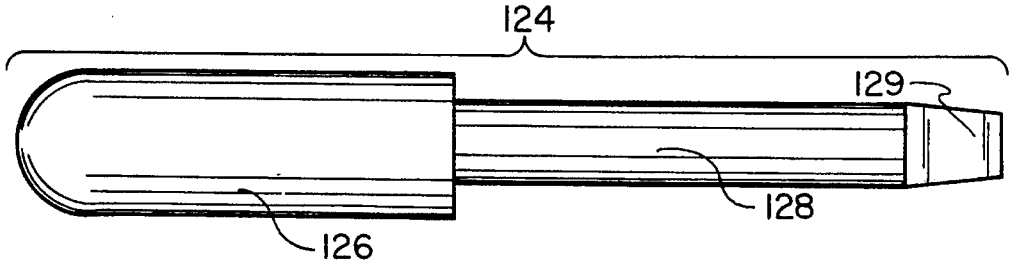
FIG. 4 is a side-elevational view of the screwdriver of the present invention.
Figure 5:
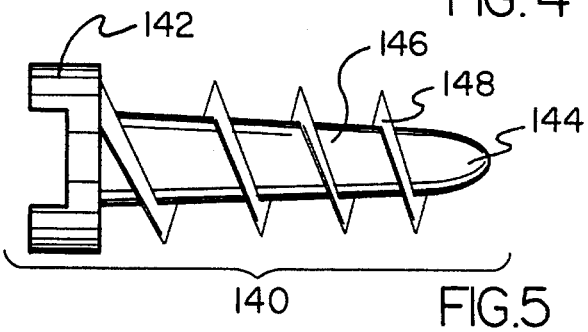
FIG. 5 is a side-elevational view of a screw of the present invention.
Figure 6:
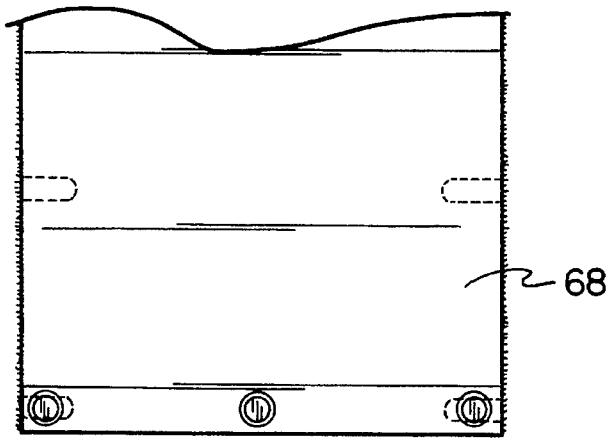
FIG. 6 is a view of the bottom portion of a side wall component of the present invention.
Figure 7:
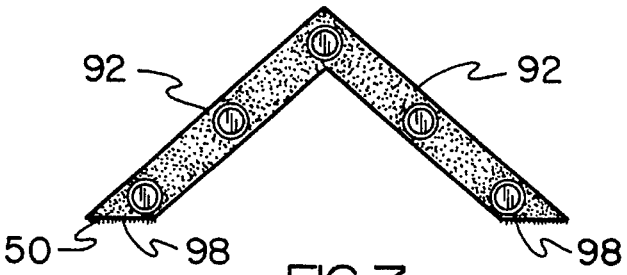
FIG. 7 is a side-elevational view of the roof component of the present invention.
Figure 8:
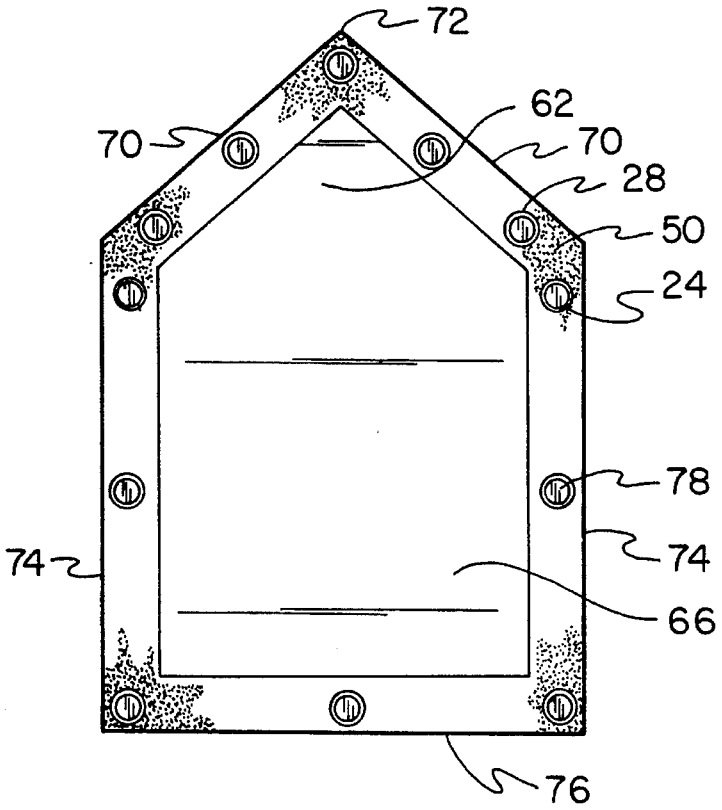
FIG. 8 is a side-elevational view of an end wall component of the present invention.
Figure 9:
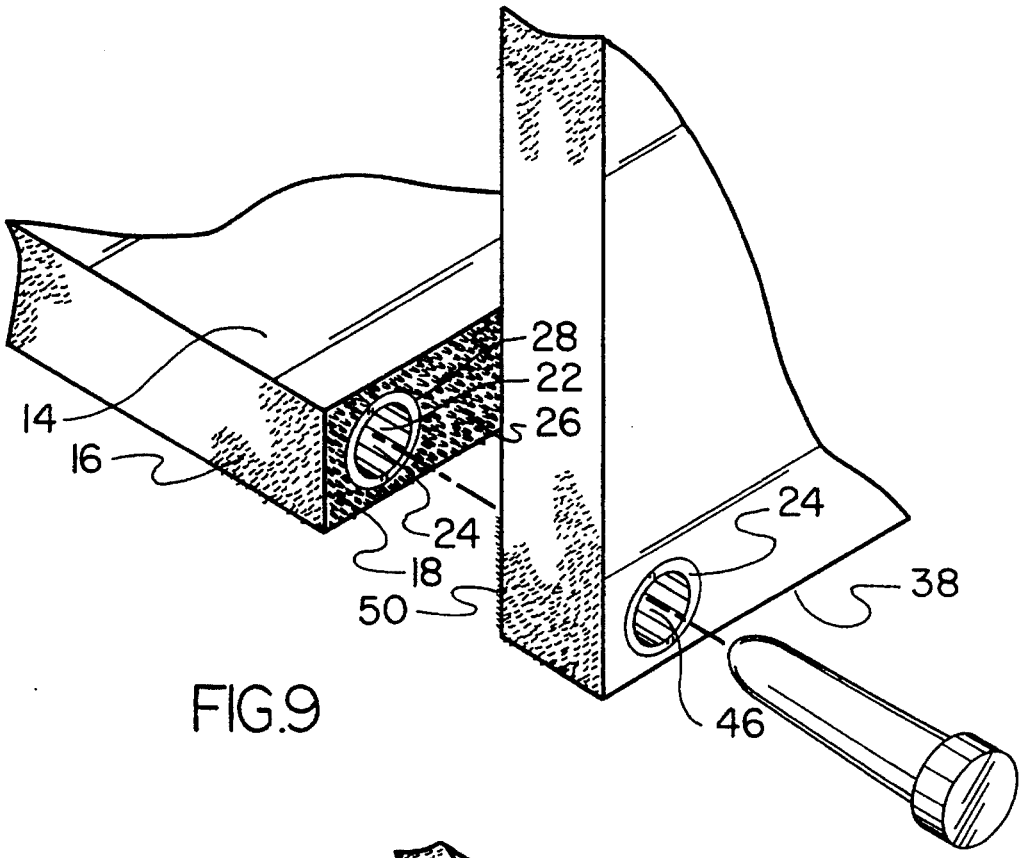
FIG. 9 is a perspective enlarged view of the coupling of the floor component with a side wall component.
Figure 10:
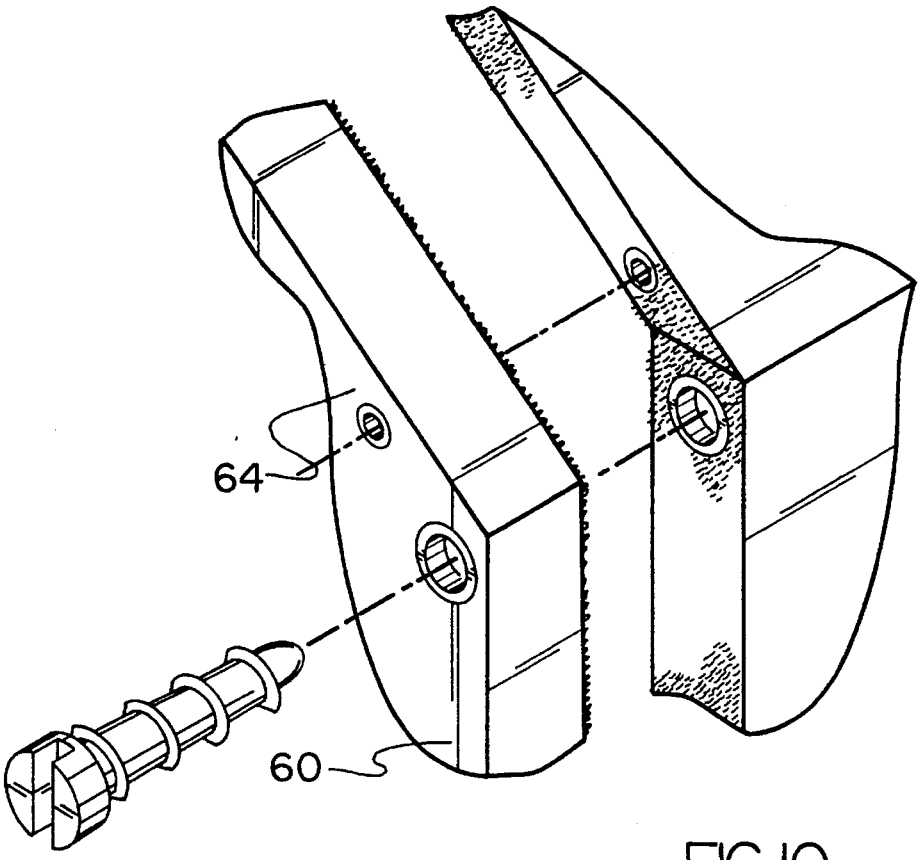
FIG. 10 is an enlarged perspective view of the coupling of an end wall component with the roof and side wall components.
Figure 11:
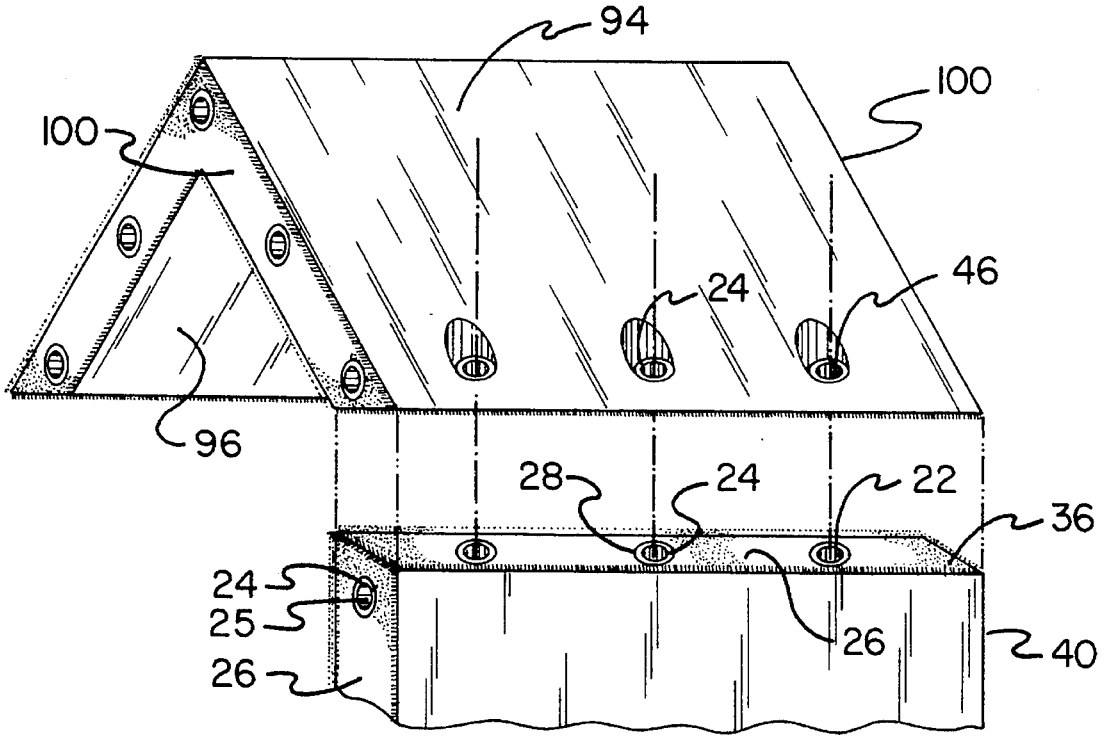
FIG. 11 is a perspective view of the coupling of the roof component with a side wall component.
Figure 12:
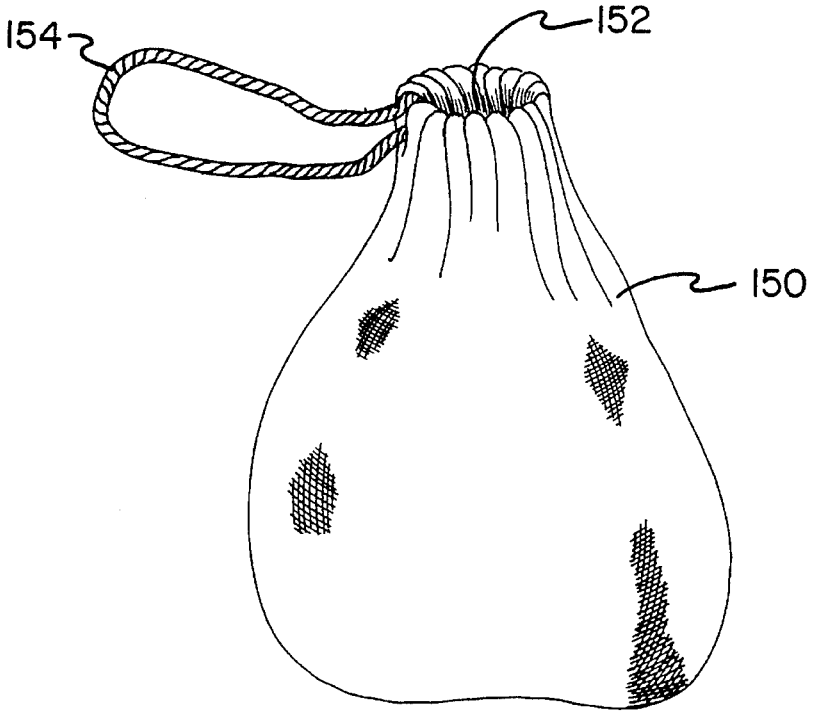
FIG. 12 is a view of the carrying bag of the present invention.

With reference now to the drawings, and in particular, to FIG. 1 thereof, the preferred embodiment of the new and improved child-constructable toys that are assembled using a system of color-coordinated components and tools embodying the principles and concepts of the present invention and generally designated by the reference number 10 will be described.

The present invention is comprised of a plurality of components. In their broadest context, such components include floor, wall, and roof components, nails and screws, and tools. Such components are individually configured and correlated with respect to each other to allow a child to construct a toy using a color-coded type scheme.

Specifically, the present invention consists of a building such as the birdhouse shown in FIG. 1. To construct the birdhouse, a floor component 12 is included. The floor component is rectangular, rigid, and planar in structure. It is formed of a plastic material of a red characteristic color. The floor component has an upper surface 14, a lower surface 16, and a periphery interconnecting the surfaces. The periphery is formed of a pair of long edges 18 with a pair of short edges 20 extended therebetween. Each long edge has a plurality of circular and spaced nail seating holes 22 formed therealong. Each nail seating hole on the floor component bears a marking circle 24 of an orange characteristic color therearound for clearly indicating the location of the nail seating hole. Each short edge has a plurality of circular, spaced, and threaded screw seating holes 25 formed therealong. Each screw seating hole on the floor component bears a marking circle 24 of a green characteristic color therearound for clearly indicating the location of the screw seating hole. Each edge of the floor component further has a strip of pile-type fastener 26 of a yellow characteristic color removably coupled thereto. Each strip on the floor component has a plurality of spaced through holes 28 formed thereon. Each through hole is axially and separately aligned with one of the nail seating holes 22. Each through hole has a diameter greater than that of the associated nail seating hole to allow the corresponding marking circle 24 to remain visible.

Also provided are a pair of side wall components 30. Each side wall component is rectangular, rigid, and planar in structure. Each side wall is formed of a plastic material with an orange characteristic color. Each side wall component has an interior surface 32, an exterior surface 34, and a periphery interconnecting the surfaces. The periphery is formed of a top edge 36, a bottom edge 38, and opposed side edges 40 extended therebetween. Each top edge has a plurality of spaced circular nail seating holes 22 disposed therealong. Each side edge of a side wall component has a plurality of threaded screw seating holes 25 disposed therealong. Furthermore, each side wall component has a plurality of nail through holes 46 disposed thereon at a location aligned with and adjacent to its bottom edge. Each nail seating hole 22 bears a marking circle 24 of an orange characteristic color. This color is used for clearly marking the location of a nail seating hole. Each nail through hole bears a marking circle 24 of an orange characteristic color therearound on both the interior surface 32 and exterior surface 30. Each marking circle is used for clearly indicating the location of the nail through hole. Each screw seating hole 25 on each side edge 40 bears a marking circle 24 of a green characteristic color therearound. Each marking circle is used for clearly indicating the location of a screw seating hole 25. Each top edge also includes a strip of pile-type fastener 26 of a blue characteristic color removably coupled thereto. The strip on the top edge has a plurality of circular and spaced through holes 28 formed therealong. Each through hole is separately and axially aligned with one of the nail seating holes 22. Each through hole also has a diameter greater than the associated nail seating hole to allow the corresponding marking circle 24 to remain visible. Each side edge of a side wall component has a strip of pile-type fastener 26 of a yellow characteristic color removably coupled thereto. Each strip on a side edge has a plurality of circular and spaced through holes 28 formed therealong. Each through hole on a side edge is separately and axially aligned with one of the screw seating holes 25. Each through hole has a diameter greater than the associated screw seating hole to allow the corresponding marking circle 24 to remain visible. Each interior surface of each side wall component has a strip of complimentary pile-type fastener 50 of a yellow characteristic color removably coupled thereto at a location aligned with the nail through holes 46. Each strip has a plurality of spaced circular through holes formed therealong. Each through hole on the interior surface is separately and axially aligned with one of the nail through holes. Each through hole also has a diameter greater than the associated nail through hole to allow the corresponding marking circle to remain visible.

A pair of end wall components 60 are also included. Each end wall is rigid and planar in structure. Each end wall is formed of a plastic material of an orange characteristic color. Each end wall component has a triangular-shaped upper portion 62 integral with a rectangular-shaped lower portion 64. Each end wall component has an interior surface 66, an exterior surface 68, and a periphery interconnecting the surfaces. The periphery is formed of a pair of angled upper side edges 70 meeting at a common apex 72, a pair of lower side edges 74 extended downwards from the upper side edges, and a bottom edge 76 perpendicularly extended between the lower side edges. Each end wall component further includes a plurality of spaced and threaded screw through holes 78 disposed therearound near the periphery thereof. Each screw through hole bears a marking circle 24 of a green characteristic color therearound on both the interior and exterior surfaces. Each end wall additionally has strips of complimentary pile-type fastener 50 of a yellow characteristic color removably coupled therearound in a border-type configuration on the interior surface 66 near its periphery. Each strip has a plurality of spaced and circular through holes 28 formed therealong. Each through hole is separately and axially aligned with one of the screw through holes 78. Each through hole has a diameter greater than the associated screw through hole to allow the corresponding marking circle to remain visible. One of the end walls further includes a circular aperture 80 disposed centrally therethrough to define an open door.

A roof component 90 is also included. The roof component is formed of a pair of interconnected plates 92 defining a V-shaped configuration. The roof is rigid in structure and formed of a plastic material of a red characteristic color. The roof has an upper surface 94, a lower surface 96, and a periphery interconnecting the upper surface with the lower surface. The periphery is formed of a pair of bottom edges 98 and a pair of opposed and V-shaped side edges 100 extended therebetween. Each bottom edge has a plurality of spaced nail through holes 46 disposed therealong. The nail holes are extended upwards from the bottom edge to the upper surface. Each nail through hole has a marking circle 24 of an orange characteristic color therearound on both the upper surface and bottom surfaces. Each bottom edge has a strip of complimentary pile-type fastener 50 of a blue characteristic color removably coupled thereto. Each strip has a plurality of spaced and circular through holes 28 formed therealong. Each through hole is separately and axially aligned with one of the nail through holes. Each through hole has a diameter greater than the associated nail through hole to allow the corresponding marking circle to remain visible.

The strips of pile type fastener used with the present invention have an upper surface and a lower surface. A layer of adhesive is applied to the lower surface and is used for coupling the strip to a component. In an alternate configuration, the strips of pile type fastener may also include a peel off paper backing covering the adhesive. In this configuration, the user would be responsible for ensuring their proper securement to the components such that they are properly color-coded.

Also included is a hammer 110. The hammer is rigid in structure and formed of a plastic material of an orange characteristic color. The hammer has an elongated hammering portion 112 with a head at one end 114, a ball 116 at the other end, and a shaft 118 therebetween. The hammer also includes an elongated tubular and hollow handle 120. The handle is extended outwards from the shaft. The handle is terminated at a sealed rounded tip end 122.

Another tool provided is a screwdriver 124. The screwdriver is rigid in structure and formed of a plastic material of a green characteristic color. The screwdriver has a handle 126 with a tubular shaft 128 extended therefrom. The shaft is terminated at a flat tip 129.

To couple some of the components together, a set of nails 130 is included. Each nail is rigid in structure and formed of a plastic material of an orange characteristic color. Each nail has a head 132 at one end, a pointed tip 134 at the other end, and a conical intermediate portion 126 therebetween. Each nail is separately disposed within a nail through hole 46, projected into and out of the through holes of a pair of corresponding coupled fastener strips, and seated within a corresponding nail seating hole 22. In this configuration, marking circles having the same color are in coaxial alignment. The nails in combination with the associated pile-type fasteners 26 and complimentary pile-type fasteners 50 secure the floor component and roof component 90 to the side wall components 30.

Also included for coupling components together is a set of screws 140. Each screw is rigid in structure and formed of a plastic material with a green characteristic color. Each screw has a slotted head 142 at one end, a pointed tip 144 at the other end, and a conical intermediate portion 146 with a helical thread 148 extended between the ends. Each screw is threadedly disposed within a screw through hole 178, projected into and out of the through holes of a pair of corresponding coupled fastener strips, and seated within a corresponding screw seating hole 25. The screws in combination with the associated pile-type fasteners 26 and complimentary pile-type fasteners 50 secure the end walls 60 to the roof component 90, the floor component 12, and the side wall components 30.

Lastly, a carrying bag 150 is included. The carrying bag is formed of a net material with a central opening 152. A drawstring 154 is secured around the central opening. The carrying bag has a size adapted for allowing the components and tools therein to be held for storage and transport.

The present invention is a system of assembling toys by following a color scheme which matches screws and nails and a tool with components to be coupled. The present invention is based on a kit including the component parts of a toy, assembly directions, and tools. The components are preformed plastic pieces that easily fit together to form a particular object. Each component is colored along the edges that attach to another component containing an edge of the same color. Tools in the kit such as hammers and screwdrivers are of the same color as the items on which they are used, like nails, holes and screws. For small children, plastic or wooden nails are used, but for older children the tools may be of standard materials found in conventional tools. The toys may be modified in complexity according to the age of the child.

Depending on the toy, the system may be used in a variety of ways. A component is chosen from the kit and other components are attached to it based on the colored edges they share in common. The tools are used to insert nails and screws in their proper locations. Once everything is assembled, the toy is complete and may be utilized.

The present invention contains many educational benefits. A child may independently learn to recognize and match colors and also learn to use tools and construct toys with them. A child's self-esteem is boosted while learning. The present invention can be very entertaining and stimulate mental growth. Another benefit is that the present invention is inexpensive and very durable.

Summarizing, most households with young children can easily be described with one word-busy. Two active and needy young children, one pet, one house, two cars, one yard and two careers is typical. Parents are better educated in today's society about raising children. They know the importance of "quality time".

With most two career families, the only time to complete household chores or projects are in the evenings and weekends. Therefore, parents are torn between duty and desire. Consequently, they encourage the participation of their children to assist them in the household responsibilities due to the limited time available. The problem remaining is supplying the necessary equipment to actively involve the children and maintain their concentration or attention span. Purchasing plastic tools or items similar as required by adult projects are rarely the answer. Even with plastic tools, few tasks are appropriate for such young children to feel they have either helped or felt the same sense of accomplishment as their parents upon completion.

Parents also purchase plastic tools simply because of the child's desire and they look fun. Plastic tools also bring back nostalgic memories to the parents. However, children quickly become bored using the tool sets due to the lack of age appropriate projects in which the use of tools are acceptable or feasible. The children soon begin beating on walls, floors, other toys, or on furniture, thus, parents and the children end up arguing which leads to negative interactions. Ultimately, the toys are discarded from pure frustration.

As a final difficulty of today's parents, toys are purchased which require much of the parent's time in reading the instructions and assistance in constructing the toy. Therefore, either the purchase of those particular toys are discouraged or the use is limited. Parents do not have the time or patience to learn how to assemble toys, read instructions and have quality time actually playing with the children. Parents read the boxes of prospective new toys closely. They want something easy to put together, easy to learn, fun to play with the children and appropriate for the children to play alone. They also want self-containers which provide convenient storage and lessen the possibility of losing pieces.

The present invention is a system of assembling color coordinated components such as toys. The system can be expanded to any item in need of assembling including items which are typically assembled prior to packaging. Color coordinated components are plastic building pieces appropriate for all ages. These pieces come in fish net type bag with a draw string for closure and self-storage. All packaged items are pre-organized and designed for specific building items.

Pre-formatted plastic pieces fit together by using color coordinated Velcro or similar material for easier assembly. All assembly devices are color coordinated. The same color is used to match holes, screwdriver and screws in which the child can learn color recognition of the necessary assembly requirements. The pieces can be put together in any order. All packages are complete with pre-designed plastic pieces which fit together to form a specific object. All tools and necessary accessories are included in each self-contained, self-closure fishnet material package.

The preferred embodiment of the present invention is the bird house as is shown in FIG. 1. The roof is red and a hammer is used for assembly. Side edges consist of strips of pile type fastener which are blue that attach to the walls. The holes in the roof are orange which can be used to hammer to the attached walls. The nails are orange as well as the hammer. The pile type fastener on the edges of the side walls of the bird house are used to attach the walls together are yellow. Screws are used to permanently attach the end walls. The screws, the screw holes and screwdriver are green. The floor is purple. The holes are orange on the floor which indicates the use of a hammer and orange nails.

The younger the child, the smaller quantity of pieces and tools should be used. The pieces should also be larger in-order for the handling to be achieved with ease. The object is for the child to be able to put together the item on his/her own. As the child becomes older, the pile type fasteners can be removed from the components. Smaller component pieces and multiple tools can be added. Also, battery operated drills and other higher technological tools can be used. Besides the birdhouse, other possibilities are housing, furniture, vehicles, and the like.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A child-constructable toy building assembled using a system of color-coordinated components and tools comprising, in combination:

a rectangular rigid planar plastic floor component of a first characteristic color, the floor component having an upper surface, a lower surface, and a periphery interconnecting the surfaces formed of a pair of long edges with a pair of short edges extended therebetween, each long edge having a plurality of circular and spaced nail seating holes formed therealong with each nail seating hole bearing a marking circle of a second characteristic color therearound, each short edge having a plurality of circular and spaced screw seating holes formed therealong with each screw seating hole bearing a marking circle of a third characteristic color therearound, each edge further having a strip of pile-type fastener of a fourth characteristic color removably coupled thereto, each strip having a plurality of spaced through holes formed thereon and with each through hole axially and separately aligned with one of the nail seating holes, each through hole having a diameter greater than that of the associated nail seating hole to allow the corresponding marking circle to remain visible;

a pair of rectangular rigid planar plastic upstanding side wall components of a second characteristic color, each side wall component having an interior surface, an exterior surface, and a periphery interconnecting the surfaces formed of a top edge, a bottom edge, and opposed side edges extended therebetween, each top edge having a plurality of spaced circular nail seating holes disposed therealong, each side edge having a plurality of threaded screw seating holes disposed therealong, each side wall component further having a plurality of nail through holes disposed thereon at a location aligned with and adjacent to the bottom edge thereof, each nail seating hole bearing a marking circle of a second characteristic color therearound, each nail through hole bearing a marking circle of a second characteristic color therearound on both the interior and exterior surfaces, each screw seating hole on each side edge bearing a marking circle of a third characteristic color therearound, each top edge having a strip of pile-type fastener of a fourth characteristic color removably coupled thereto and with each strip having a plurality of circular spaced through holes formed therealong with each through hole separately and axially aligned with one of the nail seating holes and with each through hole having a diameter greater than the associated nail seating hole to allow the corresponding marking circle to remain visible, each side edge having a strip of pile-type fastener of a fourth characteristic color removably coupled thereto and with each strip having a plurality of circular spaced through holes formed therealong with each through hole separately and axially aligned with one of the screw seating holes and with each through hole having a diameter greater than the associated screw seating hole to allow the corresponding marking circle to remain visible, each interior surface having a strip of complementary pile-type fastener of a fourth characteristic color removably coupled thereto at a location aligned with the nail through holes, each strip having a plurality of spaced circular through holes formed therealong with each through hole separately and axially aligned with one of the nail through holes and with each through hole having a diameter greater than the associated nail through hole to allow the corresponding marking circle to remain visible;

a pair of rigid planar plastic end wall components of a second characteristic color, each end wall component having a triangular-shaped upper portion integral with a rectangular-shaped lower portion, each end wall component having an interior surface, an exterior surface, and a periphery interconnecting the surfaces formed of a pair of angled upper side edges meeting at an apex, a pair of lower side edges extended downward from the upper side edges, and a bottom edge perpendicularly extended between the lower side edges, each end wall component further including a plurality of spaced and threaded screw through holes disposed therearound near the periphery thereof, each screw through hole bearing a marking circle of a third characteristic color therearound on both the interior and exterior surfaces, each end wall component additionally having strips of complimentary pile-type fastener removably coupled therearound on the interior surface near the periphery thereof and with each strip having a plurality of spaced circular through holes formed therealong and with each through hole separately and axially aligned with one of the screw through holes and with each through hole having a diameter greater than the associated screw through hole to allow the corresponding marking circle to remain visible, one of the end wall components having a circular aperture disposed centrally therethrough to define an open door;

a rigid plastic roof component of a first characteristic color formed of a pair of interconnected plates defining a V-shaped configuration, the roof having an upper surface, a lower surface, and a periphery interconnecting the upper surface with the lower surface formed of a pair of bottom edges and pair of opposed V-shaped side edges extended therebetween, each bottom edge having a plurality of spaced nail through holes disposed therealong and extended upwards through the upper surface, each nail through hole having a marking circle of a second characteristic color therearound on both the upper surface and bottom surfaces, each bottom edge having a strip of complimentary pile-type fastener of a fourth characteristic color removably coupled thereto, each strip having a plurality of spaced circular through holes formed therealong, each through hole separately and axially aligned with one of the nail through holes and with each through hole having a diameter greater than the associated nail through hole to allow the corresponding marking circle to remain visible;

a rigid plastic hammer of a second characteristic color having an elongated hammering portion with a head at one end, a ball at the other end, and a shaft therebetween and an elongated tubular hollow handle extended outwards from the shaft and terminated at a sealed rounded tip end;

a rigid plastic screwdriver of a third characteristic color having a handle with a tubular shaft extended therefrom and terminated at a flat tip;

a set of rigid plastic nails of a second characteristic color, each nail having a head at one end, a pointed tip at the other end, and a conical intermediate portion therebetween, each nail separately disposed within a nail through hole and seated within a corresponding nail seating hole and with the nails in combination with associated pile type fasteners and complementary pile type fasteners securing the floor and roof to the side wall components;

a set of rigid plastic screws of a third characteristic color, each screw having a slotted head at one end, a pointed tip end, and a conical intermediate portion with a helical thread extended between the ends, each screw threadedly disposed within a screw through hole and seated within a corresponding screw seating hole and with the screws in combination with the associated pile type fasteners and complimentary pile type fasteners securing the end wall components to the roof, floor, and side wall components; and a carrying bag formed of a net material with a central opening and a drawstring secured around the central opening, the carrying bag having a size for holding the components and tools therein for storage and transport.

2. A child-constructable toy comprising:

a set of components, each component having a characteristic color, each component further having a plurality of edges bearing other characteristic colors;

coupling means having a same characteristic color as that of a color on an edge of one component and a color on an edge of another component, the coupling means being for coupling like colored edges of the components together and with such coupling allowing at least a portion of a toy to be created, wherein the coupling means comprises a first strip of pile-type fastener of the characteristic color secured to each edge of the one component, said coupling means extending along that length as defined by that associated edge, and a second strip of pile-type fastener of the characteristic color secured to the edge of the another component, whereby contacting of the same characteristic color pile-type fasteners will couple at least two of the components together.

tool-actuateable coupling means having the same characteristic color as that of the color on the edge of the one component and the color on the edge of the another component for further coupling the like colored edges of the components together and with such coupling allowing at least a portion of a toy to be created, wherein the tool-actuateable coupling means comprises a plurality of fasteners extendable between the edges of the one component and the another component; and at least one tool operatively associated with the fasteners of the tool-actuateable coupling means for facilitating the coupling of the components together.

3. The child-constructable toy of claim 2, wherein the fasteners include at least one nail of a first color, and at least one screw of a second color, wherein the first color is in contrast relative to the second color.

4. The child-constructable toy of claim 3, wherein at least one of the components includes a nail through hole including a marking circle of the first color, and a nail seating hole including a marking circle of the first color, and further wherein at least one of the components includes a screw through hole including a marking circle of the second color, and a screw seating hole including a marking circle of the second color.

5. The child-constructable toy of claim 4, wherein the at least one tool includes a hammer of the first color.

6. The child-constructable toy of claim 4, wherein the at least one tool includes a screwdriver of the second color.

* * * * *